US007530871B2

(12) United States Patent
Scott et al.

(10) Patent No.: US 7,530,871 B2
(45) Date of Patent: May 12, 2009

(54) LIFERAFT SYSTEM

(75) Inventors: Tommy Scott, Ballyclare (GB); Peter Gordon, Liverpool (GB)

(73) Assignee: Survitec Group Limited, Belfast (GB)

( * ) Notice: Subject to any disclaimer, the term of this patent is extended or adjusted under 35 U.S.C. 154(b) by 85 days.

(21) Appl. No.: 10/560,042

(22) PCT Filed: Feb. 24, 2004

(86) PCT No.: PCT/GB2004/000725

§ 371 (c)(1),
(2), (4) Date: Jan. 29, 2007

(87) PCT Pub. No.: WO2004/110858

PCT Pub. Date: Dec. 23, 2004

(65) Prior Publication Data

US 2007/0167093 A1 Jul. 19, 2007

(30) Foreign Application Priority Data

Jun. 11, 2003 (GB) ..... 0313515.9

(51) Int. Cl.
*B63B 35/58* (2006.01)

(52) U.S. Cl. ..... 441/42

(58) Field of Classification Search ..... 114/345; 441/40, 41, 42

See application file for complete search history.

(56) References Cited

U.S. PATENT DOCUMENTS

| | | | | |
|---|---|---|---|---|
| 2,851,078 | A * | 9/1958 | Mellon et al. | 441/41 |
| 2,968,820 | A * | 1/1961 | Pritty | 441/42 |
| 3,268,925 | A | 8/1966 | Serra | |
| 4,033,002 | A * | 7/1977 | Higgs | 441/40 |
| 5,342,230 | A | 8/1994 | Louis | |
| 5,468,167 | A | 11/1995 | Givens | |
| 5,630,740 | A * | 5/1997 | Lavorata | 441/42 |
| 6,709,305 | B2 * | 3/2004 | Parrott et al. | 441/40 |
| 6,902,453 | B2 * | 6/2005 | Switlik et al. | 441/42 |

FOREIGN PATENT DOCUMENTS

| | | |
|---|---|---|
| WO | WO 97/05014 | 2/1997 |

* cited by examiner

*Primary Examiner*—Lars A Olson
(74) *Attorney, Agent, or Firm*—Stites & Harbison PLLC; Douglas E. Jackson

(57) ABSTRACT

A liferaft system has a container (10) which contains an inflatable liferaft (24) in a hermetically sealed bag (23) and an emergency pack (29) outside the bag (23). The emergency pack (29) is connected to the liferaft so that, upon inflation of the liferaft (24), the emergency pack (29) is automatically drawn into the liferaft (24). The container (10) is separable into two parts (11, 12) to allow deployment of the liferaft (24) and includes also a hatch (33) through which the emergency pack (29) can be removed and replaced without disturbing the liferaft (24).

14 Claims, 3 Drawing Sheets

LIFERAFT SYSTEM

The invention relates to liferaft systems.

GB-A-2318097 discloses a liferaft system comprising a container containing an inflatable liferaft in a hermetically sealed bag and an emergency pack connected to the liferaft. In this arrangement, upon inflation of the liferaft, the emergency pack is automatically drawn into the liferaft. The container is operable to allow deployment of the liferaft and also to allow the emergency pack to be removed and replaced during servicing of the system.

It is a problem with such a system that, in order to remove and replace the emergency pack, the container must be opened completely, as if the liferaft were being deployed. Since the liferaft in its hermetically sealed bag is usually packed compactly into the container, opening the container in this way can release the packed liferaft which can be difficult to repack in the container.

According to a first aspect of the invention, there is provided a liferaft system comprising a container containing an inflatable liferaft in a hermetically sealed first bag and an emergency pack outside the first bag and connected to the liferaft, the container being openable to allow deployment of the liferaft and including a hatch through which the emergency pack can be removed and replaced.

According to a second aspect of the invention, there is provided a method of servicing a liferaft system comprising a container containing an inflatable liferaft in a hermetically sealed bag and an emergency pack outside the first bag and connected to the liferaft the method comprising accessing the emergency pack through a hatch in the container, disconnecting the emergency pack from the liferaft, removing the emergency pack through the hatch, inserting a replacement emergency pack through the hatch into the container and connecting the replacement emergency pack to the liferaft.

Figure 1:
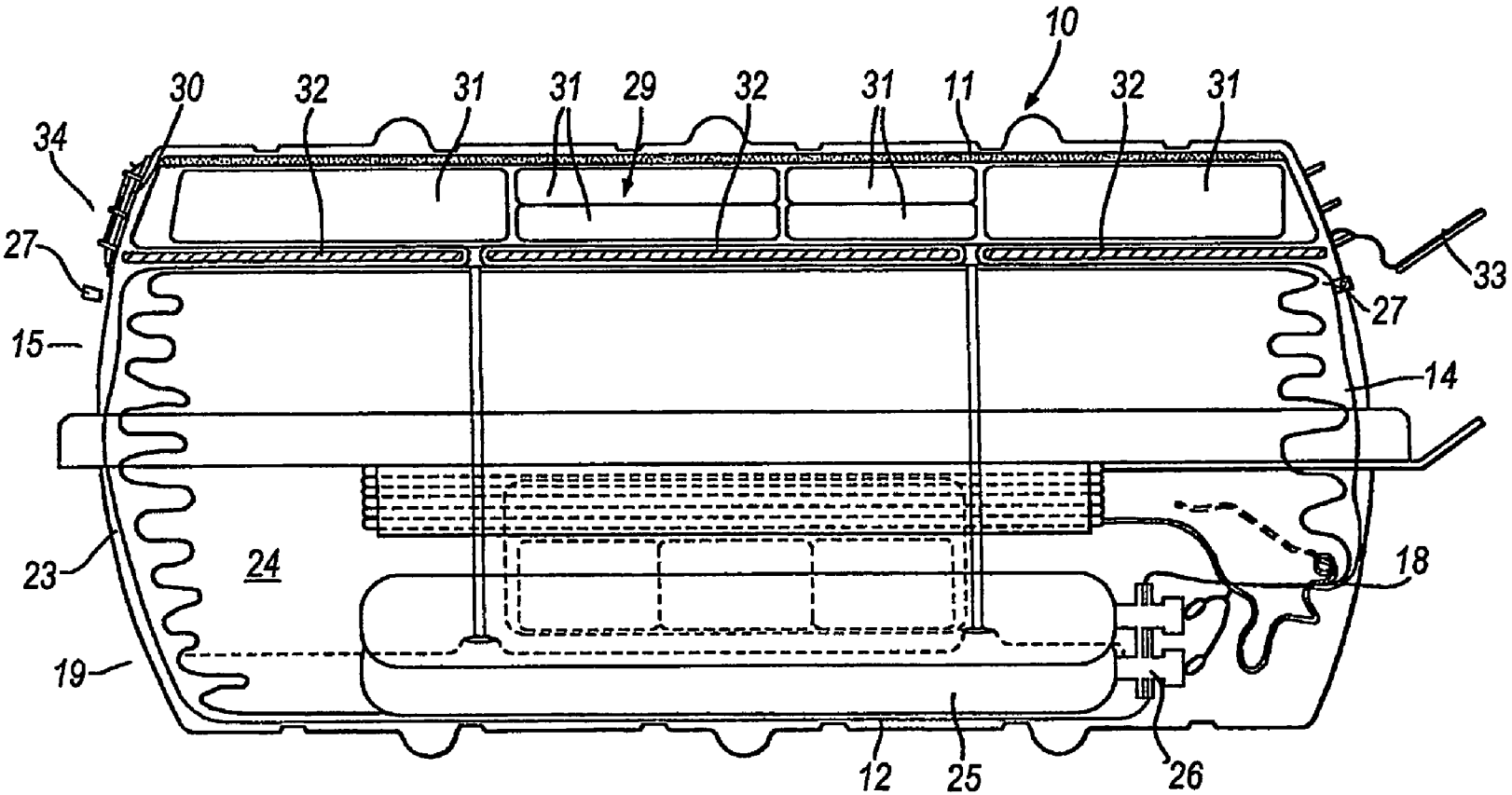
Figure 2:
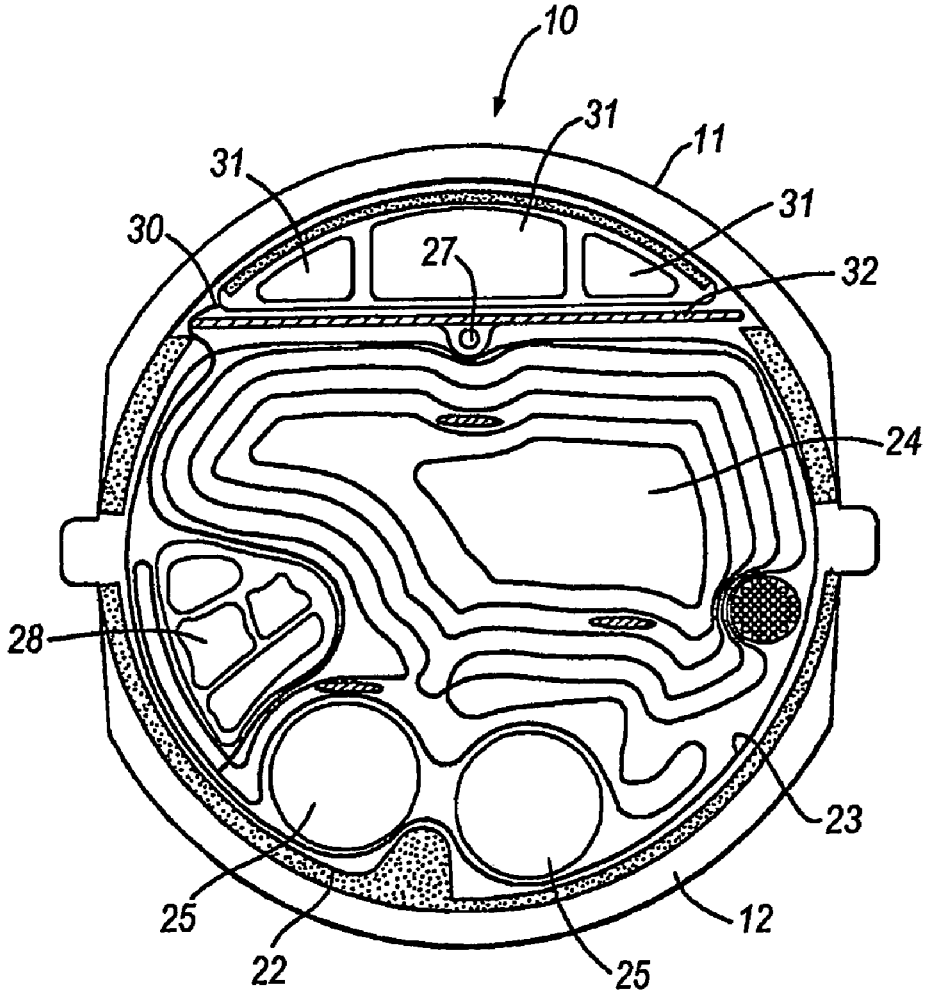
Figure 3:
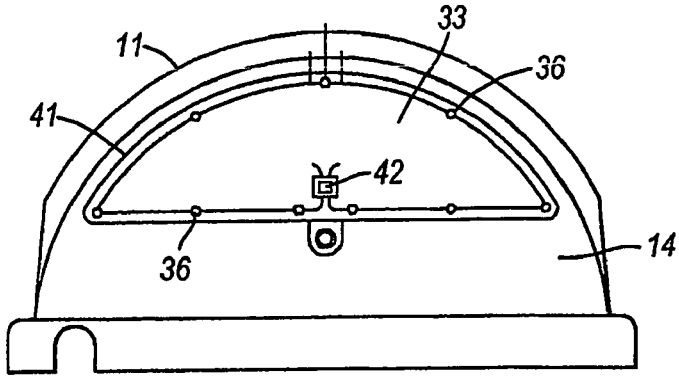
Figure 4:
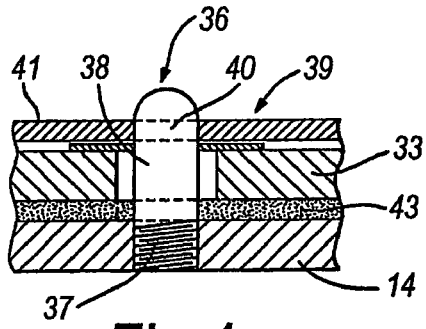
Figure 5:
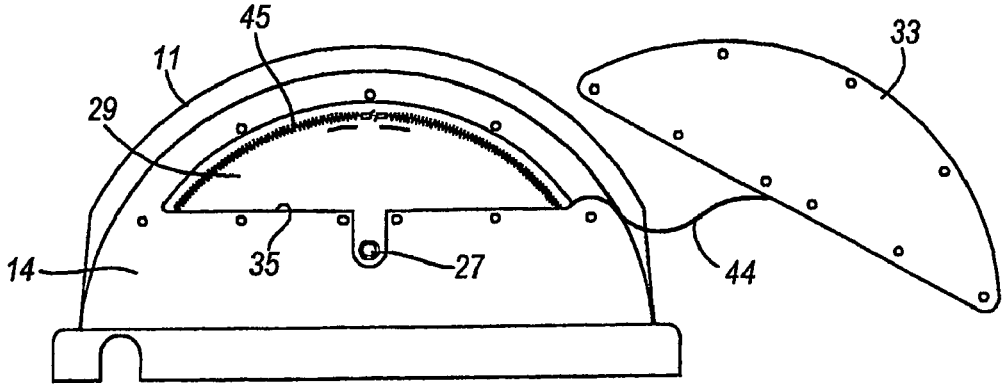

The following is a more detailed description of an embodiment of the invention, by way of example, reference being made to the accompanying drawings in which:

FIG. 1 is a longitudinal cross section through a liferaft system comprising a container including a liferaft in a hermetically sealed bag, and an emergency pack, FIG. 2 is a cross-sectional view through the liferaft system of FIG. 1, FIG. 3 is an end elevation of part of the container of the liferaft system of FIGS. 1 and 2 and showing a hatch of the liferaft system in a closed disposition, FIG. 4 is a sectional view at X on FIG. 3, and FIG. 5 is a similar view to FIG. 3 but showing the hatch removed.

Referring to the drawings, the liferaft system comprises a container indicated generally at 10 formed by a upper half shell 11 and a lower half shell 12. The upper half shell 11 is of generally semi-circular cross-section (see FIG. 2) with end walls 14, 15. Likewise, the lower half shell 12 is of generally semi-circular cross-section with end walls 18, 19. The edges of the upper half shell 11 and the edges of lower half shell 12 are provided with cooperating flanges that seal together when the two shells 11, 12 are muted together to close the container 10. The half shells 11, 12 and thus the container 10, maybe moulded from a plastics material and, as seen in FIG. 2, lined with a protective foam 22.

A hermetically sealed plastics bag 23 is located within the container. The bag 23 contains a packed deflated liferaft 24 and an inflation system including gas cylinders 25 and control valves 26. The liferaft 24 and the inflation system are of conventional type and will not be described in further detail. The hermetically sealed bag 23 includes two humidity indicators 27 which project through respective end walls 14, 15 of the upper half shell 11 so that they are visible from respective opposite ends of the container 10 from outside the container 10. The humidity indicators 27 indicates whether the integrity of the bag 23 has been compromised by humidity entering the bag 23.

The purpose of packing the liferaft 24 and the inflation system in the hermetically sealed bag 23 is to extend the service life of those items. In this way, the service life may be extended to three year intervals and possibly to five year or longer intervals. It is customary to pack with the liferaft 24 various items that might be needed by persons utilising the liferaft 24 in case of an emergency. Some such items will have a service life interval at least equal to the service life interval of the liferaft 24. An example of such an item is some forms of food. These items are contained in a lower emergency pack 28 that sits in the lower half shell 12 and is partially surrounded by the bag 23 (see FIG. 2). The lower emergency pack 28 is connected to the liferaft 24 either through the bag 23 or via the bag 23 so that, upon inflation of the liferaft 24, the emergency pack 28 is automatically drawn into the liferaft 24. An example of such a connection is shown in GB-A-2318097.

There are other emergency items such as, for example, medical supplies, which require servicing or replacement more frequently than the service interval of the liferaft 24. These items are contained in an upper emergency pack 29 best seen in FIGS. 1 and 2. This emergency pack 29 may, for example, comprise a second bag 30 connected to the liferaft 24 in the same way as the emergency pack 28 so that, upon inflation of the liferaft the upper emergency pack is automatically drawn into the liferaft 24. Again, the connection maybe as described in GB-A-2318097. The various items 31 making up the emergency pack are contained within the second bag 30.

The upper emergency pack 29 sits on three generally rectangular planar panels 32 arranged end-to-end on top of the hermetically sealed bag 23 as seen in FIGS. 1 and 2. This divides the interior of the container into a lower compartment and an upper compartment so separating the second bag 30 from the hermetically sealed bag 23 and providing support for the second bag 30.

Referring now to FIGS. 1, 3, 4 and 5, the end walls 14, 15 of the upper half shell 11 are provided with respective hatches 33, 34. Only one of the hatches 33, 34, the hatch 33, will be described in detail but it will understood that the other hatch 34 is similarly constructed.

Referring to FIGS. 3, 4 and 5 the hatch 33 is planar and in the shape of a segment of a circle which fits over a similarly shaped, but slightly smaller, aperture 35 in the associated end wall 14. The hatch 33 is connected to the remainder of the container by nine bolts 36, one of which is shown in FIG. 4. With reference to FIG. 4, each bolt 36 has a threaded end 37 that engages the part of the container 10 forming the aperture 35 and a head 38 that bears against a stainless steel washer 39 to draw the hatch 33 against the aperture 35. The head 38 also includes a hole 40 through which passes a cable 41 whose ends are connected by a tamper proof seal 42. This allows a determination of whether there has been unauthorised access to the hatch 33.

As also seen in FIG. 4, a neoprene sponge foam gasket 43 is provided between the hatch 33 and the aperture 35.

When the seal 42 is broken and the cable 41 removed, the bolts 36 can also be removed to open the hatch 33. As seen in FIG. 5, a retaining line 44 connects the separated hatch 33 to the remainder of the container 10. This removal allows access to the upper compartment above the panels 32 and to the upper emergency pack 29. As seen in FIG. 5, this can be provided with a fastener such as a zip fastener 45 to allow access to the interior of the bag 30. In this way, emergency items 31 in the bag 30 can be removed through the hatch and replaced as required. The bag 30 can then be reclosed and the hatch 33 replaced.

In this way, therefore, the emergency pack items that require servicing or replacement more frequently than the hermetically sealed liferaft 24 can be serviced or replaced without separating the upper half shell 11 from the lower half shell 12 so avoiding the need for repacking of the liferaft 24 and the lower emergency pack 28. All these items remain undisturbed in the lower compartment during the servicing of the upper emergency pack 29.

The invention claimed is:

1. A liferaft system comprising a container containing an inflatable liferaft in a hermetically sealed first bag and an emergency pack connected to the liferaft so that, upon inflation of the liferaft, the emergency pack is automatically drawn into the liferaft, the container being separable to allow deployment of the liferaft and including a hatch through which the emergency pack is to be removed and replaced, and wherein the container has an interior, the interior being divided into first and second compartments, the first compartment containing the hermetically sealed first bag and the second compartment containing the emergency pack.

2. A system according to claim 1 wherein the sealed first bag includes an inflation system for the liferaft.

3. A system according to claim 1 wherein the emergency pack is in a second bag, the second bag being connected to the liferaft and being openable to allow removal and replacement of the emergency pack.

4. A system according to claim 1 wherein the container is cylindrical with an outer wall of generally circular cross-section and ends closed by respective end walls, said hatch being formed in one of said end walls.

5. A system according to claim 4 wherein the hatch comprises a generally planar member releasably fixed to the remainder of the container.

6. A system according to claim 5 wherein the hatch is the shape of a segment of a circle.

7. A system according to claim 4 wherein the hatch is connected to the remainder of the container by threaded bolts.

8. A system according to claim 1 wherein the first compartment is formed in a lower portion of the container and the second compartment in an upper portion of the container.

9. A system according to claim 8 wherein the interior of the container is divided into said first and second compartments by a divider resting on the hermetically sealed first bag, the emergency pack resting on the divider.

10. A system according to claim 9 wherein the divider is formed by at least one panel resting on the hermetically sealed first bag.

11. A system according to claim 1 wherein the second compartment includes a second emergency pack connected to the liferaft so that, upon inflation of the liferaft, the second emergency pack is automatically drawn into the liferaft.

12. A liferaft system comprising a container containing an inflatable liferaft in a hermetically sealed bag and an emergency pack connected to the liferaft so that, upon inflation of the liferaft, the emergency pack is automatically drawn into the liferaft, the container being separable to allow deployment of the liferaft and including a hatch through which the emergency pack is to be removed and replaced, wherein the hermetically sealed bag includes a device for indicating humidity in the hermetically sealed bag, the device being visible from the exterior of the container.

13. A system according to claim 12 wherein the container has an interior, the interior being divided into first and second compartments, the first compartment containing the hermetically sealed bag and the second compartment containing the emergency pack.

14. A method of servicing a liferaft system comprising a container containing an inflatable liferaft in a hermetically sealed bag and an emergency pack connected to the liferaft so that upon inflation of the liferaft, the emergency pack is automatically drawn into the liferaft, and wherein the container has an interior, the interior being divided into first and second compartments, the first compartment containing the hermetically sealed bag and the second compartment containing the emergency pack, the method comprising the steps of:

checking humidity in the hermetically sealed bag to see if an integrity of the hermetically sealed bag has been compromised, accessing the emergency pack in the second compartment through a hatch in the container, removing the emergency pack from the second compartment through the hatch while the liferaft in the hermetically sealed bag contained in the first compartment remains undisturbed, inserting a replacement emergency pack through the hatch into the second compartment of the container and connecting the replacement emergency pack to the liferaft.

* * * * *